US011708763B2

(12) United States Patent
Tsuru et al.

(10) Patent No.: US 11,708,763 B2
(45) Date of Patent: Jul. 25, 2023

(54) TURBINE AIRFOIL

(71) Applicant: KAWASAKI JUKOGYO KABUSHIKI KAISHA, Kobe (JP)

(72) Inventors: Tomoko Tsuru, Kobe (JP); Hiroshi Taki, Kobe (JP); Daiki Nabeshima, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/702,914

(22) Filed: Mar. 24, 2022

(65) Prior Publication Data

US 2022/0213792 A1 Jul. 7, 2022

Related U.S. Application Data

(63) Continuation of application No. PCT/JP2020/034988, filed on Sep. 15, 2020.

(30) Foreign Application Priority Data

Sep. 26, 2019 (JP) ..... 2019-175092

(51) Int. Cl.

| | |
|---|---|
| ***F01D 5/18*** | (2006.01) |
| ***F01D 9/06*** | (2006.01) |
| ***F01D 25/12*** | (2006.01) |

(52) U.S. Cl.

CPC ..... *F01D 5/18* (2013.01); *F01D 9/065* (2013.01); *F01D 25/12* (2013.01); (Continued)

(58) Field of Classification Search

CPC . F01D 5/18; F01D 9/065; F01D 25/12; F05D 2220/32; F05D 2240/12; F05D 2240/30; F05D 2260/20

See application file for complete search history.

(56) References Cited

U.S. PATENT DOCUMENTS

| | | | | |
|---|---|---|---|---|
| 5,603,606 | A | 2/1997 | Glezer et al. | |
| 2007/0172354 | A1* | 7/2007 | Annerfeldt ..... | F01D 5/187 416/97 R |

(Continued)

FOREIGN PATENT DOCUMENTS

| | | | |
|---|---|---|---|
| JP | 4957131 | B2 | 6/2012 |
| JP | 2013-181543 | A | 9/2013 |

(Continued)

*Primary Examiner* — Igor Kershteyn

(74) *Attorney, Agent, or Firm* — Sughrue Mion, PLLC

(57) ABSTRACT

Provided is a turbine airfoil including: a cooling passage that allows a cooling medium to move from a base part side to a tip end part side in an airfoil height direction; a lattice structure including rib sets stacked in a lattice pattern in the cooling passage; inverting portions at opposite side edge portions of the lattice structure, each being open at a side edge portion and allowing the cooling medium to be inverted from a lattice flow passage defined between ribs of one rib set to a lattice flow passage defined between ribs of another rib set; and a communication flow passage defined between one side edge portion of the lattice structure and a side wall surface of the cooling passage, the communication flow passage extending in the airfoil height direction to communicate a plurality of lattice flow passages at the one side edge portion.

5 Claims, 7 Drawing Sheets

(52) U.S. Cl.
CPC ..... *F05D 2220/32* (2013.01); *F05D 2240/12* (2013.01); *F05D 2240/30* (2013.01); *F05D 2260/20* (2013.01)

(56) References Cited

U.S. PATENT DOCUMENTS

| | | | | |
|---|---|---|---|---|
| 2013/0034429 | A1* | 2/2013 | Carter | F01D 5/187 415/178 |
| 2013/0230379 | A1 | 9/2013 | Ali | |
| 2018/0230831 | A1* | 8/2018 | Kush | F01D 5/34 |
| 2018/0306114 | A1* | 10/2018 | Dudebout | F01D 9/065 |
| 2020/0018235 | A1 | 1/2020 | Tsuru et al. | |
| 2020/0018236 | A1 | 1/2020 | Tsuru et al. | |

FOREIGN PATENT DOCUMENTS

| | | | |
|---|---|---|---|
| WO | 2018/164148 | A1 | 9/2018 |
| WO | 2018/164149 | A1 | 9/2018 |

* cited by examiner

TURBINE AIRFOIL

CROSS REFERENCE TO THE RELATED APPLICATION

This application is a continuation application, under 35 U.S.C. § 111(a), of international application No. PCT/JP2020/034988, filed Sep. 15, 2020, which claims priority to Japanese patent application No. 2019-175092, filed Sep. 26, 2019, the entire disclosures of all of which are herein incorporated by reference as a part of this application.

BACKGROUND OF THE INVENTION

Field of the Invention

The present invention relates to a turbine airfoil for a turbine of a gas turbine. In particular, the present invention relates to a structure for cooling a turbine airfoil.

Description of Related Art

A turbine constituting a gas turbine is disposed downstream of a combustor and is supplied with high temperature combustion gas from the combustor, so that the turbine is exposed to high temperature while the gas turbine operates. Therefore, it is necessary to cool turbine airfoils, i.e., stator vanes and rotor blades. A known cooling structure for cooling such a turbine airfoil introduces a part of compressed air from a compressor into a cooling passage defined inside the airfoil and uses the compressed air as a cooling medium to cool the turbine airfoil (for example, see Patent Document 1).

Use of a part of the compressed air to cool the turbine airfoil is advantageous in that the cooling structure can be simplified because it is not necessary to introduce a cooling medium from outside. On the other hand, if a large amount of the compressed air from the compressor is used for cooling, it may lead to decreased efficiency of the engine. Therefore, cooling should be performed efficiently with a least amount of air. As a structure for cooling a turbine airfoil with high efficiency, it has been proposed to use a so-called lattice structure including a plurality of sets of ribs stacked in a lattice pattern, each set of ribs including ribs extending parallel to each other (for example, see Patent Document 2).

In general, the lattice structure includes opposite side edge portions closed by side wall surfaces. A cooling medium flowing in one flow passage of the lattice structure collides with one side wall surface and is inverted to flow into the other flow passage. Similarly, the cooling medium flowing in the other flow passage of the lattice structure collides with the other side wall surface and is inverted to flow into the one flow passage. In this way, the cooling medium repeatedly collides with and gets inverted at the wall surfaces on the opposite side edges so as to facilitate cooling in the lattice structure. In addition, when the cooling medium moves across intersections of the ribs arranged in the lattice pattern, the cooling medium swirls so as to further facilitate cooling.

Related Document

[Patent Document]

[Patent Document 1] U.S. Patent Publication No. 5603606

[Patent Document 2] JP Patent Publication No. 4957131

SUMMARY OF THE INVENTION

In a case where the cooling medium flowing in the lattice structure collides with and is inverted by the side wall surfaces which close the side edge portions, fluid resistance considerably increases near the side edge portions. Since the lattice structure includes intersections of the flow passages where the flow passages are communicated in addition to the side edge portions, if the fluid resistance increases near the side edge portions, a shortcutting flow occurs which moves through these communicated areas to go into the other flow passage without reaching the side edge portions. If such a shortcutting flow occurs, the cooling medium is not sufficiently delivered to the entire flow passages, resulting in reduced cooling efficiency. Further, this also impairs the swirls which are supposed to be generated as the flow moves across the intersections, so that sufficient cooling effects may not be obtained also for this reason.

In order to solve the above problem, an object of the present invention is to make it possible to effectively cool a turbine airfoil including a lattice structure inside the turbine airfoil, while suppressing an increase in fluid resistance at side edge portions of the lattice structure.

In order to achieve the above object, the present invention provides a turbine airfoil of a turbine which is driven by high temperature gas, the turbine airfoil including:

- a cooling passage defined between a first inner wall surface and a second inner wall surface of the turbine airfoil, the first inner wall surface and the second inner wall surface facing each other, the cooling passage allowing a cooling medium to move from a base part side to a tip end part side in a height direction of the turbine airfoil;
- a lattice structure including a first rib set and a second rib set stacked and combined in a lattice pattern, the first rib set including a plurality of ribs disposed on the first inner wall surface of the cooling passage so as to extend in a direction inclined with respect to the height direction, the second rib set including a plurality of ribs disposed on the second inner wall surface so as to extend in a direction inclined in an opposite manner to the first rib set with respect to the height direction;
- inverting portions at opposite side edge portions of the lattice structure, each of the inverting portions being open at a side edge portion and allowing the cooling medium to be inverted from a lattice flow passage defined between ribs of one of the first rib set and the second rib set to a lattice flow passage defined between ribs of another of the first rib set and the second rib set; and
- a first communication flow passage defined between a first side edge portion which is one side edge portion of the opposite side edge portions of the lattice structure and a first side wall surface of the cooling passage which faces the first side edge portion, the first communication flow passage extending in the height direction to communicate a plurality of lattice flow passages at the first side edge portion.

The turbine airfoil may also include a second communication flow passage defined between a second side edge portion which is another side edge portion of the opposite side edge portions of the lattice structure and a second side wall surface of the cooling passage which faces the second side edge portion, the second communication flow passage extending in the height direction to communicate a plurality of lattice flow passages at the second side edge portion.

According to this constitution, the cooling medium flowing in the lattice structure is inverted at the inverting portions which are located at the side edge portions of the lattice structure and do not close the lattice flow passages, and the inverting portions are communicated with the communication flow passage(s) defined outside the lattice structure. Thus, an increase in fluid resistance at the side edge portions of the lattice structure is suppressed. Accordingly, a short-cutting flow of the cooling medium is suppressed in the lattice structure so as to facilitate delivery of the cooling medium throughout the lattice flow passages. In this way, the turbine airfoil can be cooled effectively. Further, the flow of the cooling medium is directed from the base part side of the turbine airfoil, i.e., an area where the turbine airfoil is connected and where the introduction port for introducing the cooling medium into the turbine airfoil can be easily arranged, such as a rotor (in a case of a rotor blade) and a casing (in a case of a stator vane) of the turbine, toward the tip end part side, so that the structure inside the cooling passage can be simplified.

The present invention encompasses any combination of at least two features disclosed in the claims and/or the specification and/or the drawings. In particular, any combination of two or more of the appended claims should be equally construed as included within the scope of the present invention.

BRIEF DESCRIPTION OF THE DRAWINGS

The present invention will be more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like or corresponding parts throughout the several views. In the figures.

DESCRIPTION OF THE EMBODIMENTS

Figure 1:
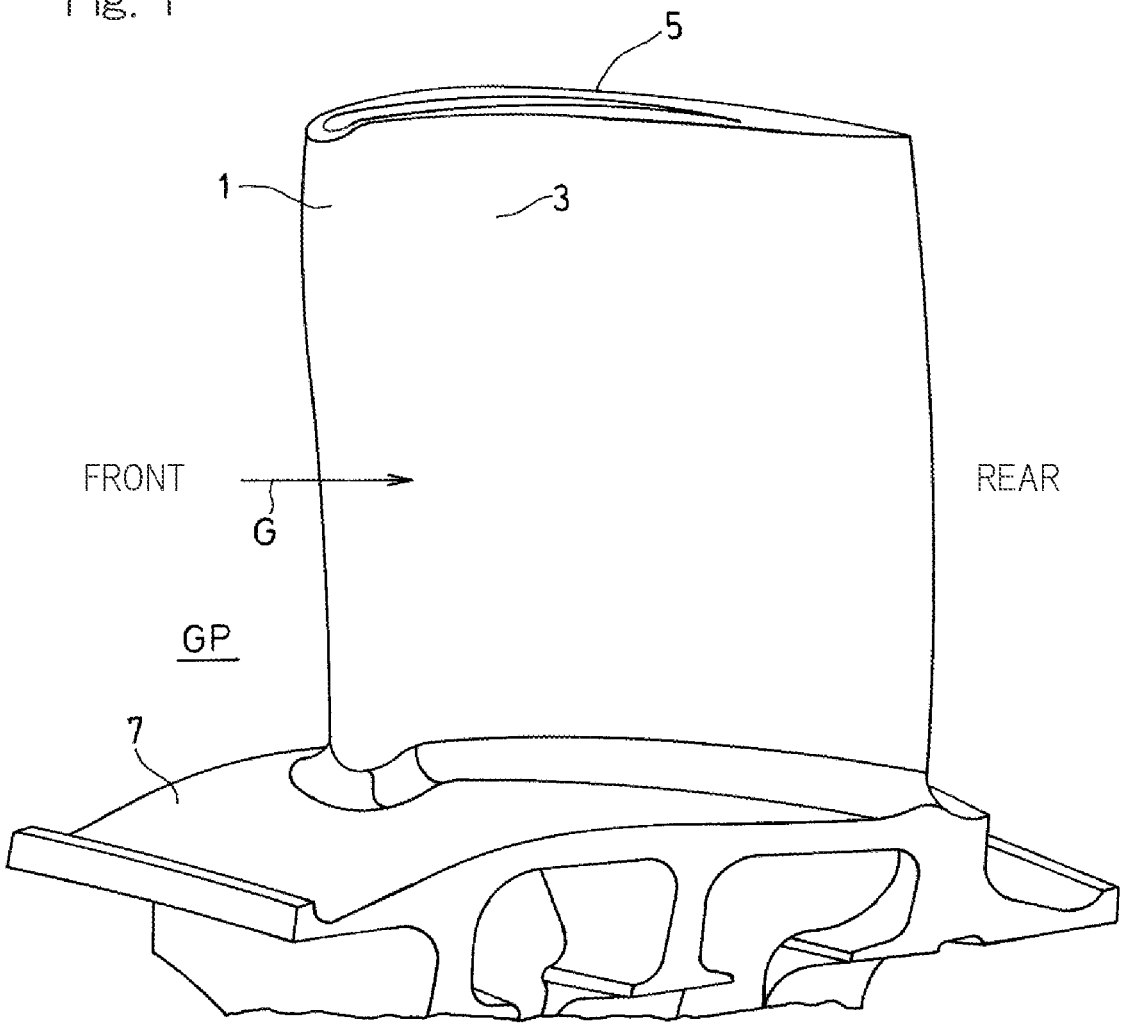
FIG. 1 is a perspective view showing an example of a turbine airfoil according to a first embodiment of the present invention.

Hereinafter, a preferred embodiment of the present invention will be described with reference to the drawings. FIG. 1 shows a rotor blade of a turbine, which is a turbine airfoil of a gas turbine according to one embodiment of the present invention. In the present specification, the term "turbine airfoil" includes a rotor blade and a stator vane of a turbine (hereinafter, simply referred to as a "rotor blade" and a "stator vane", respectively). The following description is mainly made with reference to a rotor blade as an example of the turbine airfoil, while the present invention may also be applied to a stator vane, unless specifically noted otherwise. The rotor blade 1 is a part of a turbine which is driven by high temperature gas G supplied from a non-illustrated combustor and flowing in a direction indicated by the arrow. The turbine rotor blade 1 includes a first airfoil wall 3 which is curved in a concave manner with respect to a flow passage GP of the high temperature gas G and a second airfoil wall 5 which is curved in a convex manner with respect to the flow passage GP of the high temperature gas.

In the present specification, for the sake of explanation, an airfoil wall which is curved concavely with respect to the flow passage GP of the high temperature gas G is called "first airfoil wall 3," and an airfoil wall which is curved convexly with respect to the flow passage GP of the high temperature gas is called "second airfoil wall 5" as described above. However, unless specifically noted otherwise, the configuration of the first airfoil wall 3 and the configuration of the second airfoil wall 5 are interchangeable. In addition, in the present specification, a "front" side means an upstream side (i.e., the left side in FIG. 1), and a "rear" side means a downstream side (i.e., the right side in FIG. 1) with respect to a flow direction of the high temperature gas G.

Figure 2:
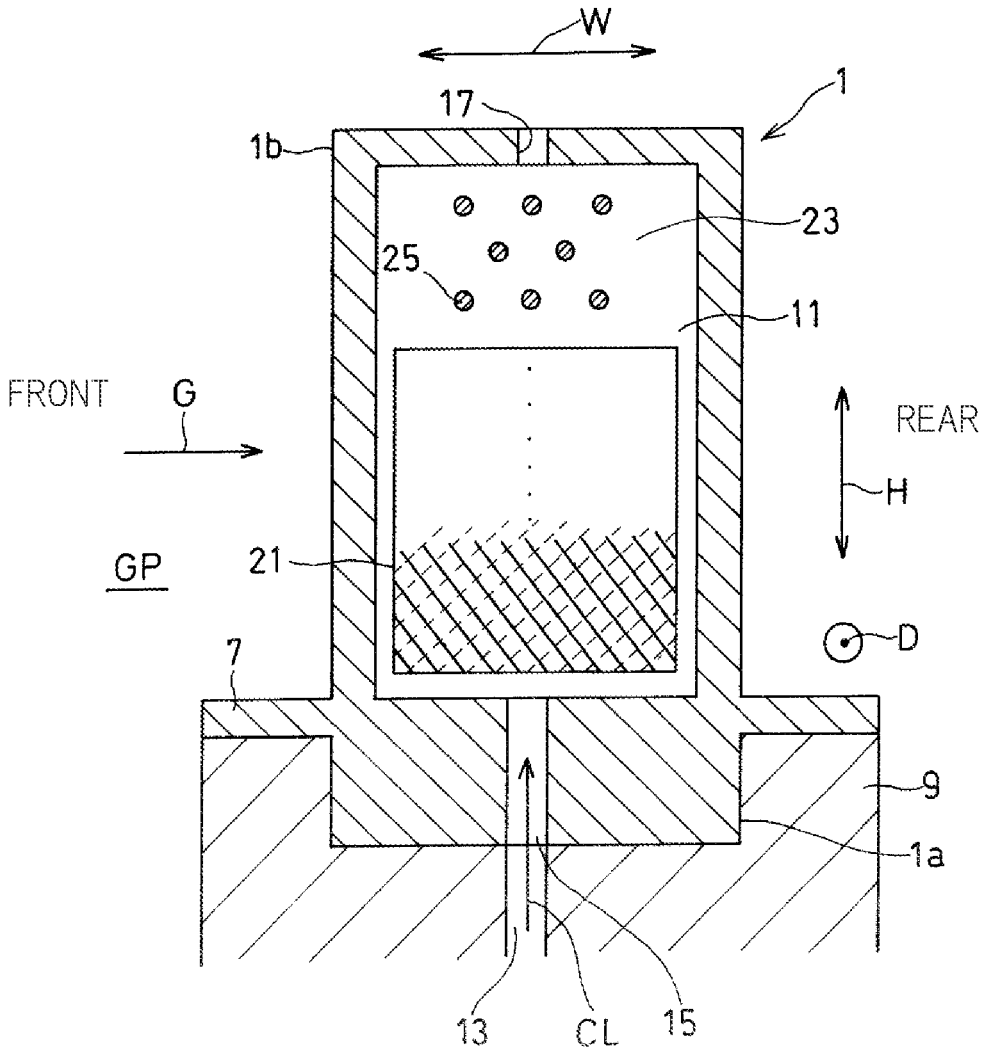
FIG. 2 is a longitudinal cross-sectional view schematically showing a cooling passage of the turbine airfoil of FIG. 1.

As shown in FIG. 2, the rotor blade 1 includes a platform 7 connected to an outer peripheral part of a turbine disk 9 which is a part of turbine rotor, such that the rotor blade 1 is implanted in the turbine rotor. Many rotor blades 1 are implanted in a circumferential direction of the turbine rotor to form the turbine. Inside the rotor blade 1 (in a space between the first airfoil wall 3 and the second airfoil wall 5 in FIG. 1), there is a cooling passage 11 which cools the rotor blade 1 from the inside.

In the following description, an "airfoil height direction H" means a height direction of the turbine airfoil (i.e., the rotor blade 1 in this example) or a radial direction of the turbine; an "airfoil width direction W" means a direction extending perpendicular to the airfoil height direction H and substantially parallel to the chord line; and an "airfoil thickness direction D" means a direction in which the first airfoil wall 3 and the second airfoil wall 5 face each other (i.e., a direction perpendicular to a plane of FIG. 2).

As shown in FIG. 2, a cooling medium CL which is a part of compressed air from a compressor passes through a cooling medium introduction passage 13 defined in the turbine disk 9 at a radially inner position and flows radially outward to enter the cooling passage 11 through a cooling medium introduction port 15 defined at an end face on the side of a base part 1*a* (a portion connected to the turbine disk 9) of the rotor blade 1. In the present embodiment, the cooling medium CL as a whole flows in a direction from the side of the base part 1*a* toward the side of a tip end part 1*b* in the airfoil height direction H within the cooling passage 11. The cooling medium CL supplied to the cooling passage 11 is discharged to outside (to the flow passage GP of the high temperature gas G) through a cooling medium discharge hole 17 defined in the tip end part 1*b* of the rotor blade 1. In the illustrated example, there is a single cooling medium discharge hole 17. Alternatively, there may be a plurality of cooling medium discharge holes 17.

Thus, the cooling medium CL is directed to flow from the side of the base part 1*a* of the turbine airfoil, i.e., an area where the turbine airfoil is connected and where the introduction port (i.e., the cooling medium introduction port 15 in the example of FIG. 2) for introducing the cooling medium CL into the turbine airfoil can be easily arranged, such as a rotor (in a case of the rotor blade 1) and a casing (in a case of a stator vane) of the turbine, toward the side of the tip end part 1*b*, so that the structure inside the cooling passage 11 can be simplified.

In the present embodiment, the cooling passage 11 extends over the entire rotor blade 1 in the airfoil width direction W. However, the cooling passage may extend only over a part of the rotor blade 1 in the airfoil width direction W, such as a rear half area of the rotor blade.

Figure 3:
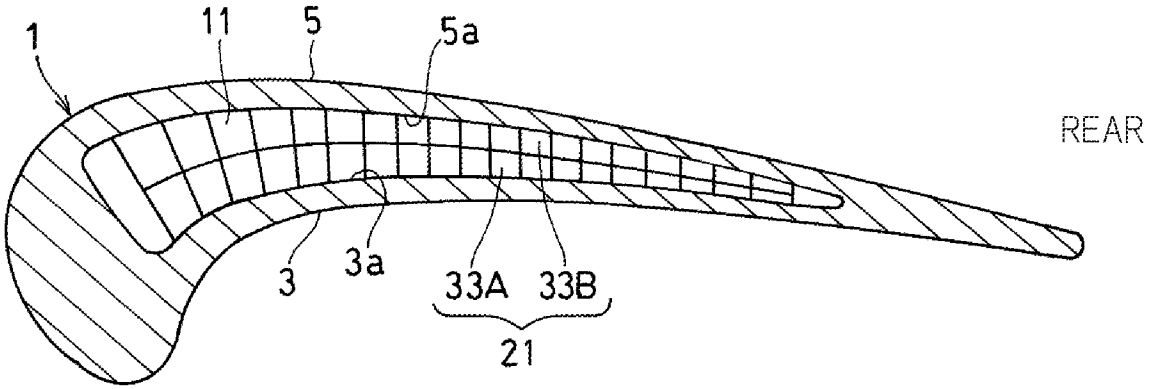
FIG. 3 is a transverse cross-sectional view of the turbine airfoil of FIG. 1.

Inside the cooling passage 11, there is a lattice structure 21 as a cooling structure for cooling the rotor blade 1. As shown in FIG. 3, the lattice structure 21 includes a plurality of ribs standing upright on a wall surface of the first airfoil wall 3 and a wall surface of the second airfoil wall 5, the wall surfaces facing the cooling passage 11. In the following description, the wall surface of the first airfoil wall 3 which faces the cooling passage 11 is called "first inner wall surface 3*a*," and the wall surface of the second airfoil wall 5 which faces the cooling passage 11 is called "second inner wall surface 5*a*."

As shown in FIG. 2, in the present embodiment, the lattice structure 21 is arranged only in a part of the cooling passage 11 on the side of the base part 1*a* in the airfoil height direction H. The cooling passage 11 includes, in a remaining part on the side of the tip end part 1*b* in the airfoil height direction H (that is, in a downstream part in the cooling passage 11), a cooling medium guiding part 23 which guides the cooling medium CL discharged from the lattice structure 21 to the cooling medium discharge hole 17. The cooling medium guiding part 23 is located in an area from an outlet of the lattice structure 21 to the cooling medium discharge hole 17 within the cooling passage 11. The first inner wall surface 3*a* and the second inner wall surface 5*a* (FIG. 3) in the cooling medium guiding part 23 are flat surfaces, except for areas where connecting support columns 25 are located as described later. That is, these wall surfaces do not include projections and recesses otherwise.

Figure 4:
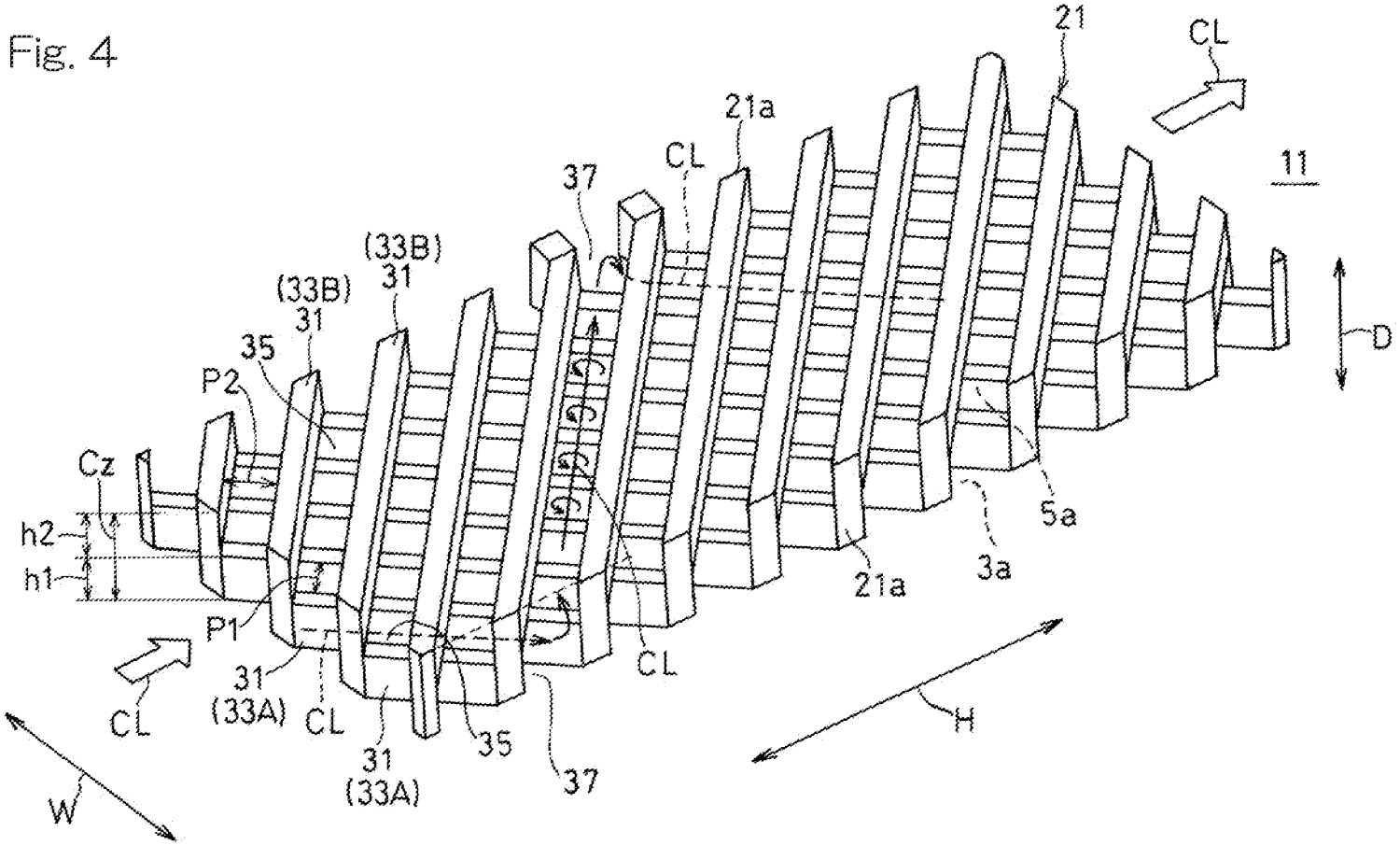
FIG. 4 is a perspective view schematically showing a lattice structure used in the turbine airfoil of FIG. 1.

As shown in FIG. 4, the lattice structure 21 includes a plurality of rib sets 33 stacked and combined in a lattice pattern on both wall surfaces 3*a*, 5*a* which face the cooling passage 11, each of the rib sets including a plurality of ribs 31 arranged parallel to each other at equal intervals. Specifically, in the present embodiment, the lattice structure 21 includes a first rib set 33A (a lower rib set in FIG. 4) which includes a plurality of ribs 31 arranged on the first inner wall surface 3*a* so as to extend in a direction inclined with respect to the airfoil height direction H and a second rib set 33B (an upper rib set in FIG. 4) which includes a plurality of ribs 31 arranged on the second inner wall surface 5*a* so as to extend in a direction inclined in an opposite manlier to the first rib set 33 with respect to the airfoil height direction H, the first rib set and the second rib set being stacked and combined in a lattice pattern in the airfoil thickness direction D.

In the lattice structure 21, gaps between the adjacent ribs 31, 31 of the respective rib sets 33 serve as flow passages (lattice flow passages) 35 for the cooling medium CL. Each lattice flow passage 35 extends inclinedly with respect to the airfoil height direction H between two side edge portions 21*a*, 21*a* of the lattice structure 21 which extend in the airfoil height direction H. In the present specification, a "side edge portion 21*a*" of the lattice structure 21 means an edge part of the lattice structure 21 in the airfoil width direction W.

Figure 5:
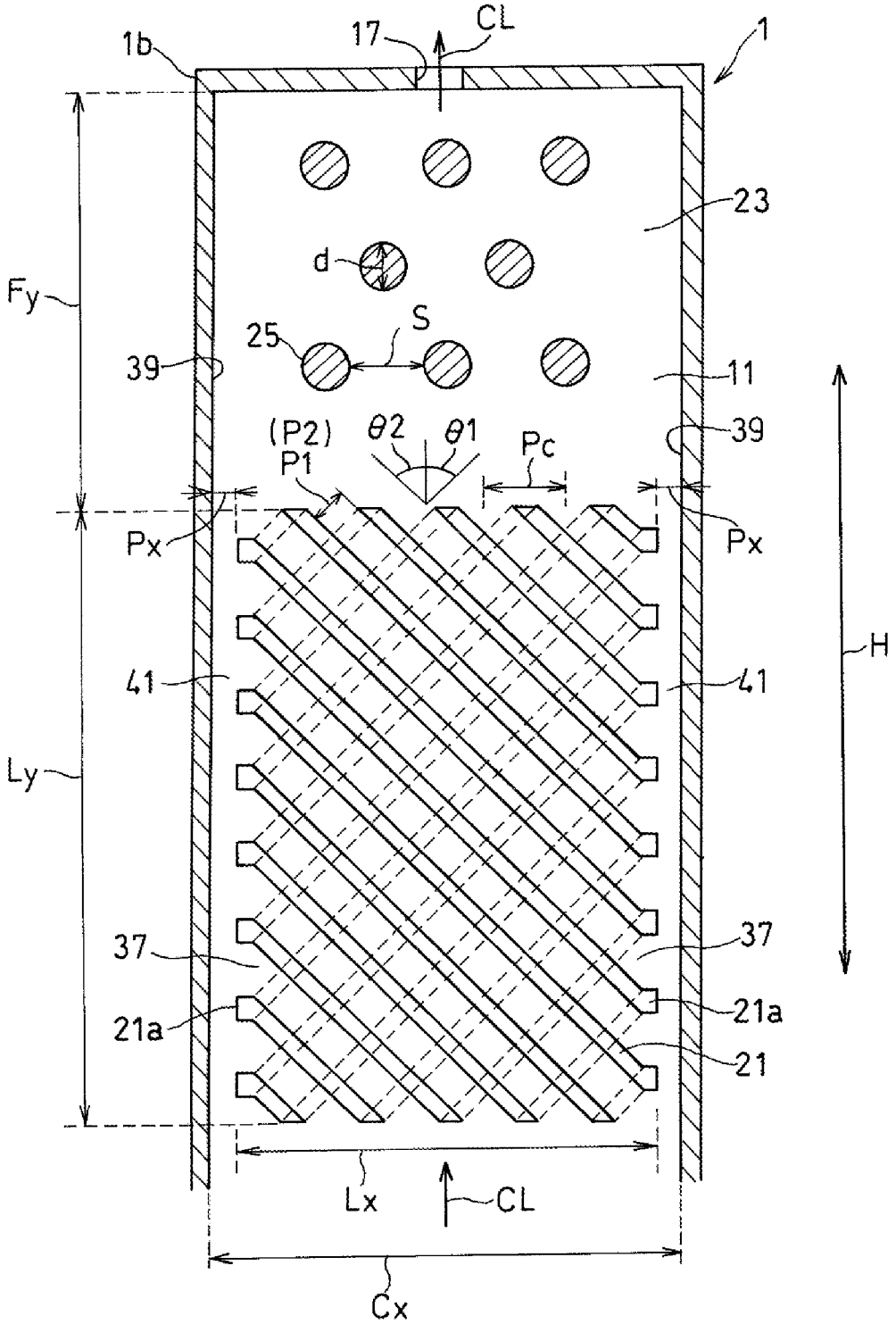
FIG. 5 is a longitudinal cross-sectional view showing a part of FIG. 2 in an enlarged manner.

As shown in FIG. 5, in the present embodiment, the first rib set 33A is inclined with respect to the height direction H at an inclination angle θ1 of 45°. The second rib set 33B is inclined in an opposite manner to the first rib set 33A with respect to the height direction H at an inclination angle θ2 of 45°. Thus, the extension direction of the first rib set 33A and the extension direction of the second rib set 33B form an angle of approximately 90° therebetween. The inclination angles θ1, θ2 are not limited to 45°.

As shown in FIG. 4, the lattice structure 21 includes inverting portions 37 at the both side edge portions 21*a*, 21*a*, each of the inverting portions being open at a respective side edge portion 21*a* and allowing the cooling medium CL to be inverted from a lattice flow passage 35 defined in one of the rib sets 33 to a lattice flow passage 35 defined in the other of the rib sets 33.

Figure 6:
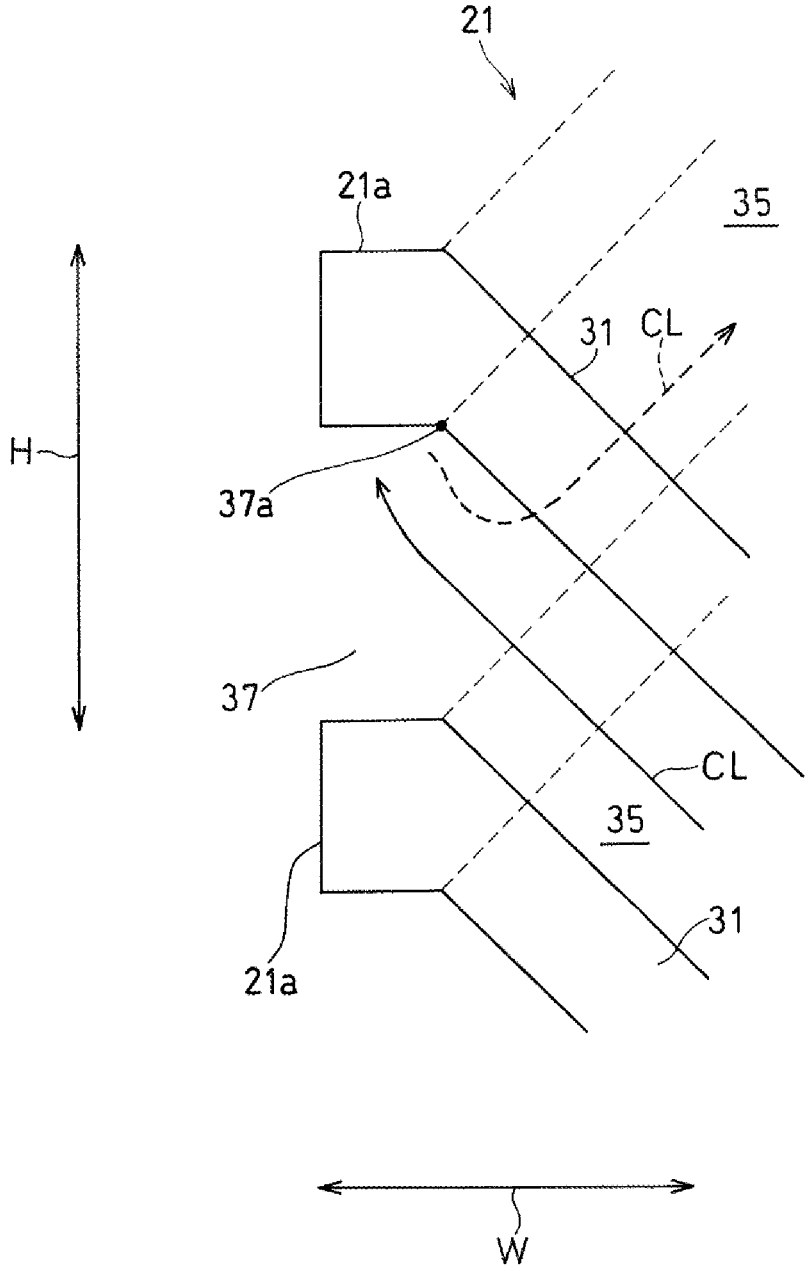
FIG. 6 is a longitudinal cross-sectional view showing connection parts of FIG. 5.

Specifically, as shown in FIG. 6, each inverting portion 37 of the lattice structure 21 includes, at the side edge portion 21*a*, a deflected portion of at least a rib 31 located on the downstream side (or on the side of the tip end part 1*b* in the airfoil height direction H; on the upper side in FIG. 6) among two ribs 31, 31 which define a corresponding lattice flow passage 35, the deflected portion being deflected toward an inner side of that lattice flow passage 35 with respect to the inclination direction of that rib 31. In the illustrated example, each inverting portion 37 includes, at a side edge portion 21*a* of the lattice structure, a deflected portion of a rib 31 located on the downstream side with respect to a corresponding lattice flow passage 35, the deflected portion being bent at a bent part 37*a* to extend in the airfoil width direction W. In the illustrated example, for easy formation of the inverting portions 37, each rib 31 located on the upstream side with respect to a corresponding lattice flow passage 35 is also deflected at a side edge portion 21*a* to extend in the airfoil width direction W.

Figure 7:
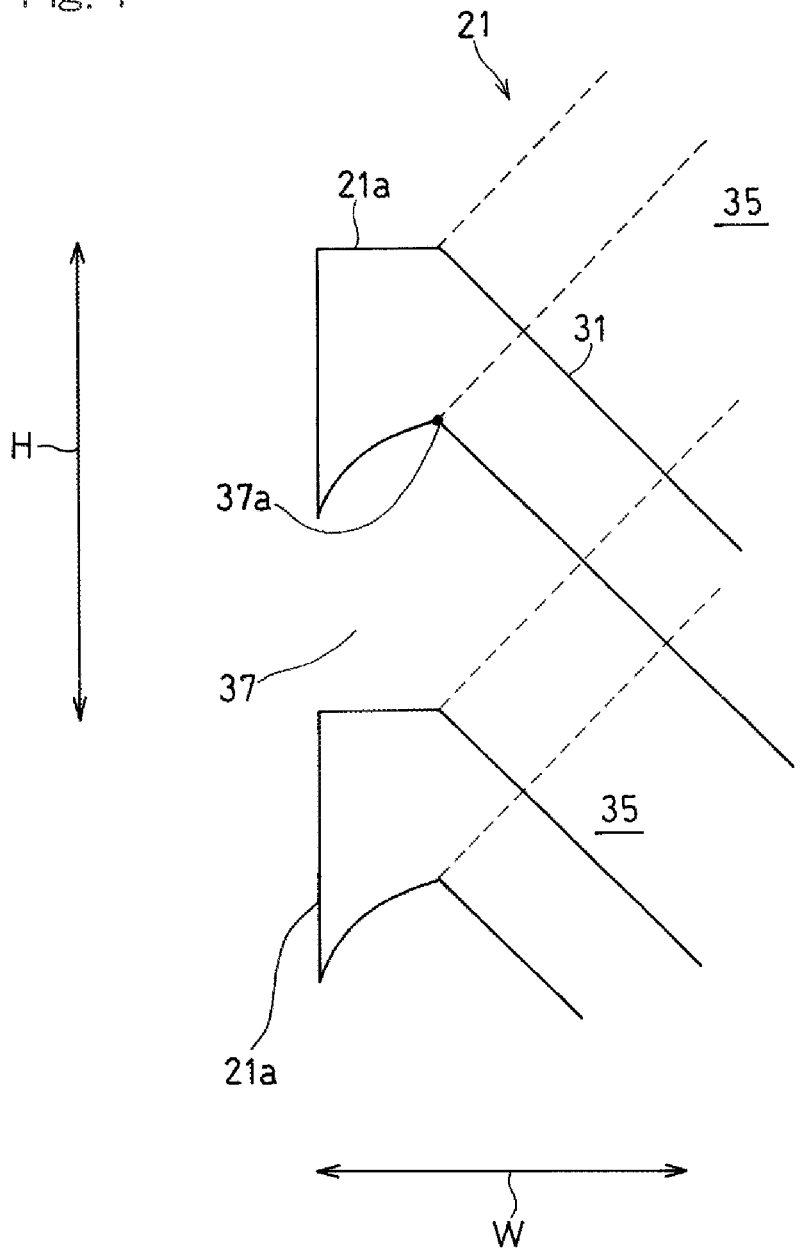
FIG. 7 is a longitudinal cross-sectional view showing a variant of the connection parts of FIG. 6.

The shape of each inverting portion 37 of the lattice structure 21 is not limited to the above example as long as each rib 31 located on the downstream side with respect to a corresponding lattice flow passage 35 is deflected at the side edge portion 21*a* toward the inner side of that lattice flow passage 35 with respect to the inclination direction of that rib 31. For example, as shown in FIG. 7, each rib 31 located on the downstream side with respect to a lattice flow passage 35 may be curved at the side edge portion 21*a* toward the inner side of that lattice flow passage 35 with respect to the inclination direction of that rib 31. Each rib 31 located on the upstream side with respect to a corresponding lattice flow passage 35 may not necessarily be deflected as shown in FIG. 7.

As shown in FIG. 5, in the present embodiment, the turbine airfoil further includes communication flow passages 41 extending in the airfoil height direction H and defined between opposite side edge portions 21*a* of the lattice structure 21 and respective side wall surfaces 39, 39 of the cooling passage 11 which face the corresponding side edge portions 21*a*. In other words, the lattice structure 21 has a smaller dimension Lx in the airfoil width direction than a dimension Cx of the cooling passage 11 in the airfoil width direction and is located at equal intervals from the opposite side wall surfaces 39, 39 of the cooling passage 11. The respective gaps between the opposite side edge portions 21*a*, 21*a* of the thus-arranged lattice structure 21 and the opposite side wall surfaces 39, 39 of the cooling passage 11 serve as communication flow passages 41. As described above, the inverting portions 37 at the opposite side edge portions 21*a* of the lattice structure 21 are open at the respective side edge portions 21*a*, so that the plurality of lattice flow passages 35 (inverting portions 37) are communicated with each other at the respective side edge portions 21*a* by the communication flow passages 41.

As shown in FIG. 4, the cooling medium CL introduced to the lattice structure 21 first flows in the lattice flow passages 35 of one rib set 33 (in the illustrated example, the first rib set 33A on the lower level) as indicated with a dashed arrow in FIG. 4 and moves across the other rib set 33 (in the illustrated example, the second rib set 33B on the upper level) to collide with the inverting portions 37 at the side edge portions 21*a*. The cooling medium CL having collided with the inverting portions 37 then is inverted to flow into the lattice flow passages 35 of the other rib set 33 (in the illustrated example, the second rib set 33B on the upper level) as indicated with a solid arrow in FIG. 4. Upon the inversion, the cooling medium CL is caused to swirl strongly. Thereafter, as the cooling medium CL moves across the other rib set 33, a swirling force is periodically applied to the swirls, so that the swirls are maintained. Thus, the generated and maintained swirls of the cooling medium CL facilitate cooling of the wall surfaces 3*a*, 5*a*. FIG. 4 only shows the inverting portions 37 at opposite ends of one lattice flow passage 35, with other inverting portions omitted in the figure.

In the present embodiment, at respective outlet parts of the lattice flow passages 35, the respective ribs 31 of the first rib set 33A and the second rib set 33B have a same height, i.e., a same lattice flow passage height h1, h2 in the airfoil thickness direction. In addition, the ribs 31 of the first rib set 33A and the ribs 31 of the second rib set 33B are arranged at a same interval. That is, a lattice flow passage width P1 of the first rib set 33A is equal to a lattice flow passage width P2 of the second rib set 33B. A ratio of the lattice flow passage height h1, h2 to the lattice flow passage width P1, P2 of each lattice flow passage 35 (i.e., an aspect ratio of each lattice flow passage 35) is not limited to a specific value and may preferably fall within a range approximately from 0.5 to 1.5 in terms of avoiding deformation of the swirls generated in the lattice structure 21 as described above and exfoliation from the wall surfaces. In the present embodiment, each lattice flow passage 35 has an aspect ratio of 1.

As shown in FIG. 5, in the present embodiment, the inverting portions 37 which invert the cooling medium CL are open at the respective side edge portions 21*a*. That is, the inverting portions do not close the respective lattice flow passages 35. Further, the respective inverting portions 37 are communicated with the communication flow passages 41 which are defined on outer sides with respect to the inverting portions. Thus, an increase in fluid resistance of the cooling medium CL near the inverting portions 37 is suppressed. As a result, the cooling medium CL surely reaches the side edge portions 21*a* of the lattice structure 21 without shortcutting in the middle of the lattice flow passages 35 and is inverted at the inverting portions 37.

A flow passage width Px of each communication flow passages 41 is not limited to a particular value. However, if the flow passage width Px is too large, the cooling medium CL tends to flow into the communication flow passages 41 from the inverting portions 37, so that the cooling medium CL is not inverted sufficiently at the inverting portions 37. If the flow passage width Px is too small, on the other hand, a sufficient effect cannot be obtained in suppressing an increase in the fluid resistance of the cooling medium CL at the inverting portions 37. Considering these points, the flow passage width Px of each communication flow passage 41 may preferably fall within a range approximately from 1 to 3 times the lattice flow passage height h1, h2, or in other words, approximately from 0.5 to 1.5 times a cooling passage height Cz (a dimension of the cooling passage 11 in the airfoil thickness direction D). In FIG. 5, for simplicity of the illustration, the communication flow passages 41 are illustrated as if they have a constant flow passage width Px over the entire length thereof. However, in general, the rotor blade 1 has a varying chord line dimension in the airfoil height direction H, so that there may also be a varying dimension which can be allocated to the communication flow passages 41 in association therewith. In addition, the rotor blade 1 also has a varying airfoil width dimension in the airfoil height direction H, so that the cooling passage 11 may also have a varying passage height Cz(=h1+h2) in association therewith. Accordingly, the flow passage width Px of each communication flow passage 41 may also vary in the airfoil height direction H.

Further, the lattice structure 21 in this case may preferably have a dimension Ly in the airfoil height direction with respect to the dimension Lx in the airfoil width direction such that all the lattice flow passages 35 reach at least one of the side edge portions 21*a*. Considering these points, the dimension Lx may preferably be from 1.5 to 2 times the value of Ly/tan θ1.

In the present embodiment, the lattice structure 21 includes the communication flow passages 41, 41 at the respective side edge portions 21*a*, 21*a* on opposite sides. However, there may be a communication flow passage 41 at only one of the side edge portions 21*a*.

Further, in the present embodiment, the outlets of the respective communication flow passages 41 are open at the above-mentioned cooling medium guiding part 23, and the cooling medium discharge hole 17 is located downstream of the cooling medium guiding part 23. Such a constitution allows the cooling medium CL flowing in the communication flow passages 41 to be discharged smoothly from the outlets, so that an increase in the fluid resistance at the side edge portions 21*a* of the lattice structure 21 is further effectively suppressed. Further, it is preferable to reduce a weight increase due to the lattice structure 21 disposed inside the rotor blade 1 to the minimum necessary. Therefore, the lattice structure 21 is arranged only on the side of the base part 1*a* where cooling is highly necessary as compared with the tip end part 1*b* because the base part is an area where a large stress acts in the rotor blade 1, so that effective cooling is achieved while a weight increase is suppressed. Note that the rotor blade may not necessarily include the cooling medium guiding part 23, and the lattice structure 21 may extend to the tip end part 1*b* of the rotor blade 1.

Where there is the cooling medium guiding part 23, a length Fy of the cooling medium guiding part in the airfoil height direction H is not limited to a particular value. However, the length Fy may preferably be from approximately 3 to 7 times the cooling passage height Cz (FIG. 4) at the outlet of the lattice structure 21.

In the present embodiment, the cooling medium guiding part 23 includes a connecting support column 25 which connects the first inner wall surface 3*a* and the second inner wall surface 5*a*. In the illustrated example, pin members each having a cylindrical shape are used as connecting support columns 25. Where the cooling medium guiding part 23 includes the connecting support column 25, the airfoil walls 3, 5 can be prevented from deformation, and the passage height of the cooling passage 11 can be secured.

In the illustrated example, a plurality of (8 in this example) connecting support columns 25 are arranged in a staggered manner. The shape, dimension, number and arrangement of the connecting support column(s) 25 may be suitably chosen so as to sufficiently prevent deformation of the airfoil walls 3, 5 and so as not to excessively disturb the flow of the cooling medium CL to the cooling medium discharge hole 17. Considering these points, more specifically, a diameter d of each connecting support column 25 may preferably be from approximately 0.5 to 1.5 times the lattice flow passage width P1, P2, and an arrangement interval S between the connecting support columns 25 may preferably fall within a range from 0.5 times the flow passage pitch Pc at the outlet of each lattice flow passage 35

(i.e., a unit dimension of each lattice flow passage 35 in the airfoil width direction W) to 0.5 times the dimension Lx of the lattice structure 21 in the airfoil width direction. The shape, number and arrangement of the connecting support column(s) 25 may be suitably chosen depending on the area of the cooling medium guiding part 23 and/or the distance between the airfoil walls, i.e., the passage height of the cooling passage 11 etc. Even where there is the cooling medium guiding part 23, the connecting support column(s) 25 may be omitted.

As described above, according to the turbine airfoil of the present one embodiment, the cooling medium CL flowing in the lattice structure 21 is inverted at the inverting portions 37 which are located at the side edge portions 21*a* of the lattice structure 21 and do not close the lattice flow passages 35, and the inverting portions 37 are communicated with the communication flow passages 41 which are located outside the lattice structure 21. Thus, an increase in the fluid resistance at the side edge portions 21*a* of the lattice structure 21 is suppressed. Accordingly, a shortcutting flow of the cooling medium CL is suppressed in the lattice structure 21 so as to facilitate delivery of the cooling medium throughout the lattice flow passages 35. In this way, the cooling medium CL can be reliably inverted and be caused to swirl at the side edge portions 21*a* of the lattice structure 21, so that the turbine airfoil can be cooled effectively. Further, the flow of the cooling medium CL is directed from the base part side of the turbine airfoil, i.e., an area where the turbine airfoil is connected and where the introduction port for introducing the cooling medium CL into the turbine airfoil can be easily arranged, such as a rotor (in a case of the rotor blade 1) and a casing (in a case of a stator vane), of the turbine, toward the tip end part side, so that the structure inside the cooling passage 11 can be simplified.

In one embodiment of the present invention, each of the inverting portions 37 may include, at a side edge portion 21*a* of the lattice structure, a deflected portion of at least a rib located on the downstream side among two ribs 31, 31 which define a corresponding lattice flow passage 35, the deflected portion being deflected toward an inner side of that lattice flow passage 35 with respect to an inclination direction of that rib 31. According to this constitution, the cooling medium CL having reached to the side edge portions 21*a* of the lattice structure 21 can be inverted at the inverting portions with a simple configuration.

In one embodiment of the present invention, the turbine airfoil may include a cooling medium discharge hole 17 which is located at the tip end part 1*b* and discharges the cooling medium CL within the cooling passage 11 to outside of the turbine airfoil, and the cooling passage 11 may include a cooling medium guiding part 23 which is located in an area on the side of the tip end part 1*b* and guides the cooling medium CL toward the cooling medium discharge hole 17. According to this constitution, the cooling medium guiding part 23 allows the cooling medium CL flowing in the communication flow passages 41 to be discharged smoothly from the area where the lattice structure 21 is located toward the tip end part 1*b* of the turbine airfoil 1. Thus, an increase in a static pressure at the side edge portions 21*a* of the lattice structure 21 can be more effectively suppressed.

In one embodiment of the present invention, the cooling medium guiding part may include a connecting support column 25 which connects the first inner wall surface 3*a* and the second inner wall surface 5*a*. According to this constitution, it is possible to prevent deformation of the airfoil walls 3, 5 in the cooling medium guiding part 23 and to secure the height of the cooling passage 11.

Although the present invention has been described in terms of the preferred embodiments thereof with reference to the drawings, various additions, modifications, or deletions may be made without departing from the scope of the invention. Accordingly, such variants are included within the scope of the present invention.

REFERENCE NUMERALS

1 . . . rotor blade (turbine airfoil)
1*a* . . . base part of the rotor blade
1*b* . . . tip end part of the rotor blade
11 . . . cooling passage
10 . . . cooling structure
17 . . . cooling medium discharge hole
21 . . . lattice structure
21*a* . . . side edge portion of the lattice structure
23 . . . cooling medium guiding part
25 . . . connecting support column
31 . . . rib of the lattice structure
33 . . . rib set of the lattice structure
37 . . . inverting portion
39 . . . side wall surface of the cooling passage
41 . . . communication flow passage
CL . . . cooling medium
G . . . high temperature gas

What is claimed is:

1. A turbine airfoil of a turbine which is driven by high temperature gas, the turbine airfoil comprising:

a cooling passage defined between a first inner wall surface and a second inner wall surface of the turbine airfoil, the first inner wall surface and the second inner wall surface facing each other, the cooling passage allowing a cooling medium to move from a base part side to a tip end part side in a height direction of the turbine airfoil;

a lattice structure including a first rib set and a second rib set stacked and combined in a lattice pattern, the first rib set including a plurality of ribs disposed on the first inner wall surface of the cooling passage so as to extend in a direction inclined with respect to the height direction, the second rib set including a plurality of ribs disposed on the second inner wall surface so as to extend in a direction inclined in an opposite manner to the first rib set with respect to the height direction;

inverting portions at opposite side edge portions of the lattice structure, each of the inverting portions being open at a side edge portion and allowing the cooling medium to be inverted from a lattice flow passage defined between ribs of one of the first rib set and the second rib set to a lattice flow passage defined between ribs of another of the first rib set and the second rib set; and a first communication flow passage defined between a first side edge portion which is one side edge portion of the opposite side edge portions of the lattice structure and a first side wall surface of the cooling passage facing the first side edge portion, the first communication flow passage extending in the height direction to communicate a plurality of lattice flow passages at the first side edge portion.

2. The turbine airfoil as claimed in claim 1, wherein each of the inverting portions includes a deflected portion, at a side edge portion of at least a rib located on a downstream side among two ribs defining a corresponding lattice flow passage, the deflected portion being deflected toward an inner side of the lattice flow passage with respect to an inclination direction of that rib.

3. The turbine airfoil as claimed in claim 1, comprising a cooling medium discharge hole that is located at a tip end part of the turbine airfoil and discharges the cooling medium within the cooling passage to outside of the turbine airfoil, wherein the cooling passage includes a cooling medium guiding part that is located in an area on the tip end part side and guides the cooling medium toward the cooling medium discharge hole.

4. The turbine airfoil as claimed in claim 3, wherein the cooling medium guiding part includes a connecting support column that connects the first inner wall surface and the second inner wall surface.

5. The turbine airfoil as claimed in claim 1, comprising a second communication flow passage defined between a second side edge portion which is another side edge portion of the opposite side edge portions of the lattice structure and a second side wall surface of the cooling passage facing the second side edge portion, the second communication flow passage extending in the height direction to communicate a plurality of lattice flow passages at the second side edge portion.

* * * * *